US010360922B2

(12) United States Patent
Nishikawa et al.

(10) Patent No.: US 10,360,922 B2
(45) Date of Patent: Jul. 23, 2019

(54) NOISE REDUCTION DEVICE AND METHOD FOR REDUCING NOISE

(71) Applicant: Panasonic Corporation, Osaka (JP)

(72) Inventors: Tsuyoki Nishikawa, Osaka (JP); Kohhei Hayashida, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 20 days.

(21) Appl. No.: 15/702,890

(22) Filed: Sep. 13, 2017

(65) Prior Publication Data

US 2018/0096697 A1 Apr. 5, 2018

Related U.S. Application Data

(60) Provisional application No. 62/402,179, filed on Sep. 30, 2016.

(30) Foreign Application Priority Data

Jun. 15, 2017 (JP) ..... 2017-117795

(51) Int. Cl.
*H04R 3/00* (2006.01)
*H04R 1/02* (2006.01)
(Continued)

(52) U.S. Cl.
CPC ..... *G10L 21/0232* (2013.01); *G10L 21/0208* (2013.01); *H04R 1/406* (2013.01);
(Continued)

(58) Field of Classification Search
CPC .... H04R 1/406; H04R 3/005; H04R 2499/11; H04R 2410/01; H04R 2410/03;
(Continued)

(56) References Cited

U.S. PATENT DOCUMENTS 8,942,976 B2 * 1/2015 Li ..... G10L 21/0208 372/19
9,716,946 B2 * 7/2017 Goshen ..... H04R 5/027
(Continued)

FOREIGN PATENT DOCUMENTS

JP 2011-512732 4/2011
WO 2009/097407 8/2009

*Primary Examiner* — Xu Mei
(74) *Attorney, Agent, or Firm* — Greenblum & Bernstein, P.L.C.

(57) ABSTRACT

A noise reduction device includes an acoustic characteristic determination unit, a microphone pair selection unit, and a noise reduction unit. The acoustic characteristic determination unit determines, using one of microphone pair signals obtained from a plurality of microphone pairs, whether acoustic characteristics of each of the plurality of microphone pairs satisfy a certain requirement. The microphone pair selection unit selects, from among the plurality of microphone pairs, a target microphone pair whose acoustic characteristics have been determined to satisfy the certain requirement. The noise reduction unit reduces, using a microphone pair signal obtained from the target microphone pair, noise included in an input signal obtained from at least one of microphone signals output from a plurality of microphones.

13 Claims, 16 Drawing Sheets

(51) Int. Cl.

| | |
|---|---|
| ***G10L 21/0232*** | (2013.01) |
| ***H04R 1/40*** | (2006.01) |
| ***G10L 21/0208*** | (2013.01) |
| *G10L 21/0216* | (2013.01) |

(52) U.S. Cl.
CPC .... *H04R 3/005* (2013.01); *G10L 2021/02166* (2013.01); *H04R 2499/11* (2013.01)

(58) Field of Classification Search
CPC ..... H04R 2410/05; G10L 21/0208; G10L 2021/02161; G10L 2021/02166
USPC ..... 381/26, 58, 91, 92, 122, 111, 113, 381/94.1–94.8; 367/138
See application file for complete search history.

(56) References Cited

U.S. PATENT DOCUMENTS

| | | | | |
|---|---|---|---|---|
| 9,866,957 | B2 * | 1/2018 | Katagiri | H04R 3/005 |
| 10,085,087 | B2 * | 9/2018 | Katagiri | G10L 25/51 |
| 2012/0076316 | A1 * | 3/2012 | Zhu | H04R 3/005 381/71.11 |
| 2015/0063590 | A1 * | 3/2015 | Katagiri | H04R 1/406 381/92 |

* cited by examiner

NOISE REDUCTION DEVICE AND METHOD FOR REDUCING NOISE

BACKGROUND

1. Technical Field

The present disclosure relates to a noise reduction device and a method for reducing noise.

2. Description of the Related Art

A technique for reducing noise included in a speech signal obtained by a microphone is known. Japanese Patent No. 4981975 discloses a method for improving the speech detection performance of a mobile device.

SUMMARY

One non-limiting and exemplary embodiment provides a noise reduction device capable of effectively reducing noise.

In one general aspect, the techniques disclosed here feature a noise reduction device including a plurality of microphones, a processor, and a memory storing a computer program, which, when executed by the processor, causes the processor to perform operations including obtaining a microphone set signal from each of a plurality of microphone sets, each of which includes arbitrary two or more of the plurality of microphones, determining, using the microphone set signal, whether an acoustic characteristic of each of the plurality of microphone sets satisfies a certain requirement, selecting, from among the plurality of microphone sets, a target microphone set, whose acoustic characteristic has been determined to satisfy the certain requirement, and reducing, using the microphone set signal obtained from the target microphone set, noise included in an input signal obtained from at least one of microphone signals output from the plurality of microphones.

The noise reduction device according to the aspect of the present disclosure can effectively reduce noise.

It should be noted that this general or specific aspect may be implemented as a system, a method, an integrated circuit, a computer program, a computer-readable recording medium such as a compact disc read-only memory (CD-ROM), or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
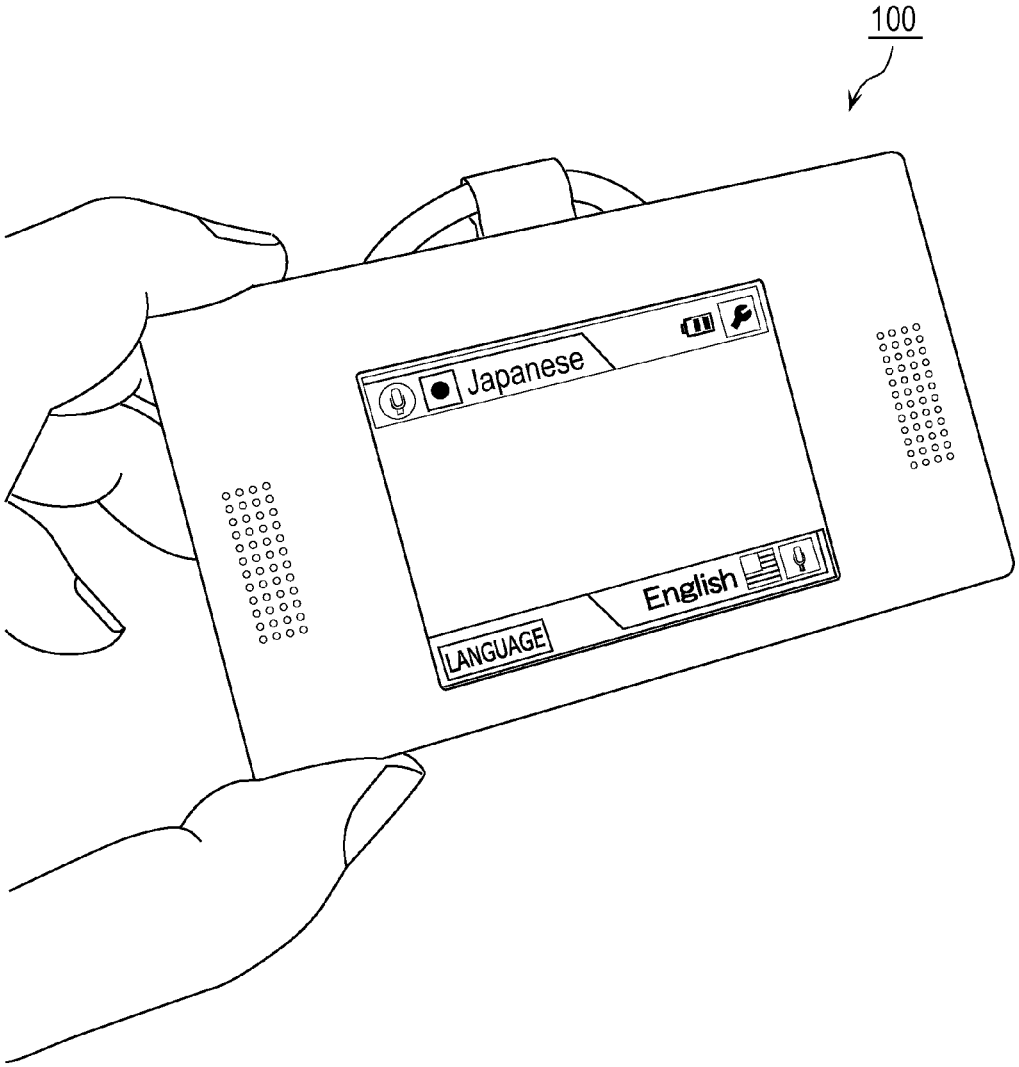
FIG. 1 is a perspective view of an automatic translation apparatus according to a first embodiment.

A noise reduction device according to an aspect of the present disclosure includes a plurality of microphones, a processor, and a memory storing a computer program, which, when executed by the processor, causes the processor to perform operations including obtaining a microphone set signal from each of a plurality of microphone sets, each of which includes arbitrary two or more of the plurality of microphones, determining, using the microphone set signal, whether an acoustic characteristic of each of the plurality of microphone sets satisfies a certain requirement, selecting, from among the plurality of microphone sets, a target microphone set, whose acoustic characteristic has been determined to satisfy the certain requirement, and reducing, using the microphone set signal obtained from the target microphone set, noise included in an input signal obtained from at least one of microphone signals output from the plurality of microphones.

As a result, since a microphone set whose acoustic characteristic does not satisfy the certain requirement is excluded in the reduction of noise, the noise reduction device can effectively reduce noise.

In addition, for example, in the noise reduction device, the operations may further include selecting, from among the plurality of microphones, a target microphone included in the target microphone set. In the reducing, the noise included in the input signal, which is a microphone signal obtained from the target microphone, may be reduced.

In this case, since microphones that are not included in a target microphone set, whose acoustic characteristic satisfies the certain requirement, are excluded in the reduction of noise, the noise reduction device can effectively reduce noise.

In addition, for example, in the noise reduction device, the operations may further include detecting a target period for which sound levels of the microphone signals output from the plurality of microphones are higher than a certain level. The determining may be performed using microphone set signals obtained from the plurality of microphone sets in the target period.

In this case, since whether acoustic characteristics satisfy the certain requirement is determined during a target period, for which a speech sound input to the plurality of microphones has a certain level of volume, the accuracy of the determination improves.

In addition, for example, in the noise reduction device, the operations may further include detecting, as an utterance start timing, a timing of an operation performed by a user before the user utters a speech sound. The determining may be performed using microphone set signals obtained from the plurality of microphone sets after the detected utterance start timing.

In this case, since whether acoustic characteristics satisfy the certain requirement is determined during a period in which the user's speech sound is supposed to be input to the plurality of microphones, the accuracy of the determination improves.

In addition, for example, in the noise reduction device, the operations may further include detecting a sound output start timing of a sound output device provided around the plurality of microphones. The determining may be performed using microphone set signals obtained from the plurality of microphone sets after the detected sound output start timing.

In this case, since whether acoustic characteristics satisfy the certain requirement is determined during a period in which a sound output from the sound output device is supposed to be input to the plurality of microphones, the accuracy of the determination improves.

In addition, for example, the noise reduction device may further include a recording medium storing the microphone signals output from the plurality of microphones. If it is determined in the determining that an acoustic characteristic of at least one of the plurality of microphone sets does not satisfy the certain requirement, the noise included in the input signal obtained from at least one of the microphone signals output from the plurality of microphones and stored in the recording medium before the determining may be reduced in the reducing.

In this case, omission of a beginning of a speech sound is suppressed.

In addition, for example, in the noise reduction device, the operations may further include notifying a user of an abnormality on the basis of a result of the determining.

In this case, the noise reduction device can notify the user of an abnormality.

In addition, for example, in the noise reduction device, the operations may further include notifying a user of an abnormality on the basis of a result of the selecting.

In this case, the noise reduction device can notify the user of an abnormality.

In addition, for example, in the noise reduction device, the operations may further include notifying a user of an abnormality on the basis of a signal level of an output signal, which is the input signal whose noise has been reduced in the reducing.

In this case, the noise reduction device can notify the user of an abnormality.

It should be noted that this general or specific aspect may be implemented as a system, a method, an integrated circuit, a computer program, a computer-readable recording medium such as a CD-ROM, or any selective combination thereof.

For example, a method for reducing noise according to an aspect of the present disclosure includes obtaining a microphone set signal from each of a plurality of microphone sets, each of which includes arbitrary two or more of the plurality of microphones, determining, using the microphone set signal, whether an acoustic characteristic of each of the plurality of microphone sets satisfies a certain requirement, selecting, from among the plurality of microphone sets, a target microphone set, whose acoustic characteristic has been determined to satisfy the certain requirement, and reducing, using the microphone set signal obtained from the target microphone set, noise included in an input signal obtained from at least one of microphone signals output from the plurality of microphones.

With the method, noise can be effectively reduced. The method is executed by a computer or the like.

For example, a non-transitory recording medium according to an aspect of the present disclosure is a non-transitory recording medium storing a computer program, which, when executed by a processor, causes the processor to perform the method.

The computer that executes the program can effectively reduce noise.

Embodiments will be described hereinafter with reference to the drawings. The following embodiments are general or specific examples. Values, shapes, materials, components, arrangement positions and connection modes of the components, steps, the order of the steps, and the like are examples, and do not limit the present disclosure. Among the components described in the following embodiments, ones not described in the independent claims, which define broadest concepts, will be described as arbitrary components.

The drawings are schematic diagrams, not strict diagrams. In the drawings, substantially the same components are given the same reference numerals, and redundant description might be omitted or simplified.

First Embodiment

Configuration of Noise Reduction Device

A noise reduction device 10 according to a first embodiment will be described hereinafter. The noise reduction device 10 according to the first embodiment is included, for example, in an automatic translation apparatus 100 illustrated in FIG. 1. FIG. 1 is a perspective view of the automatic translation apparatus 100.

The automatic translation apparatus 100 illustrated in FIG. 1 is a pendant automatic translation apparatus. The automatic translation apparatus 100 translates a speech sound uttered by a user in a first language into a second language and outputs a translation as a speech sound. The automatic translation apparatus 100 includes, for example, a plurality of microphones 20, the noise reduction device 10, a speech recognition device, a translation device, and a sound output device. In the automatic translation apparatus 100, the plurality of microphones 20 obtain a speech sound uttered by the user, the noise reduction device 10 reduces noise, and a resultant signal is output to the speech recognition device. The speech recognition device performs a process for recognizing a speech sound on the signal, the translation device translates the speech sound, and the sound output device outputs a speech sound obtained as a result of the translation.

If there is an obstacle, such as a hand of the user, around one of the plurality of microphones 20, transmission characteristics between the user and the microphone 20 change. In this case, sufficient noise reduction effects undesirably might not be produced by the noise reduction device 10.

Figure 2:
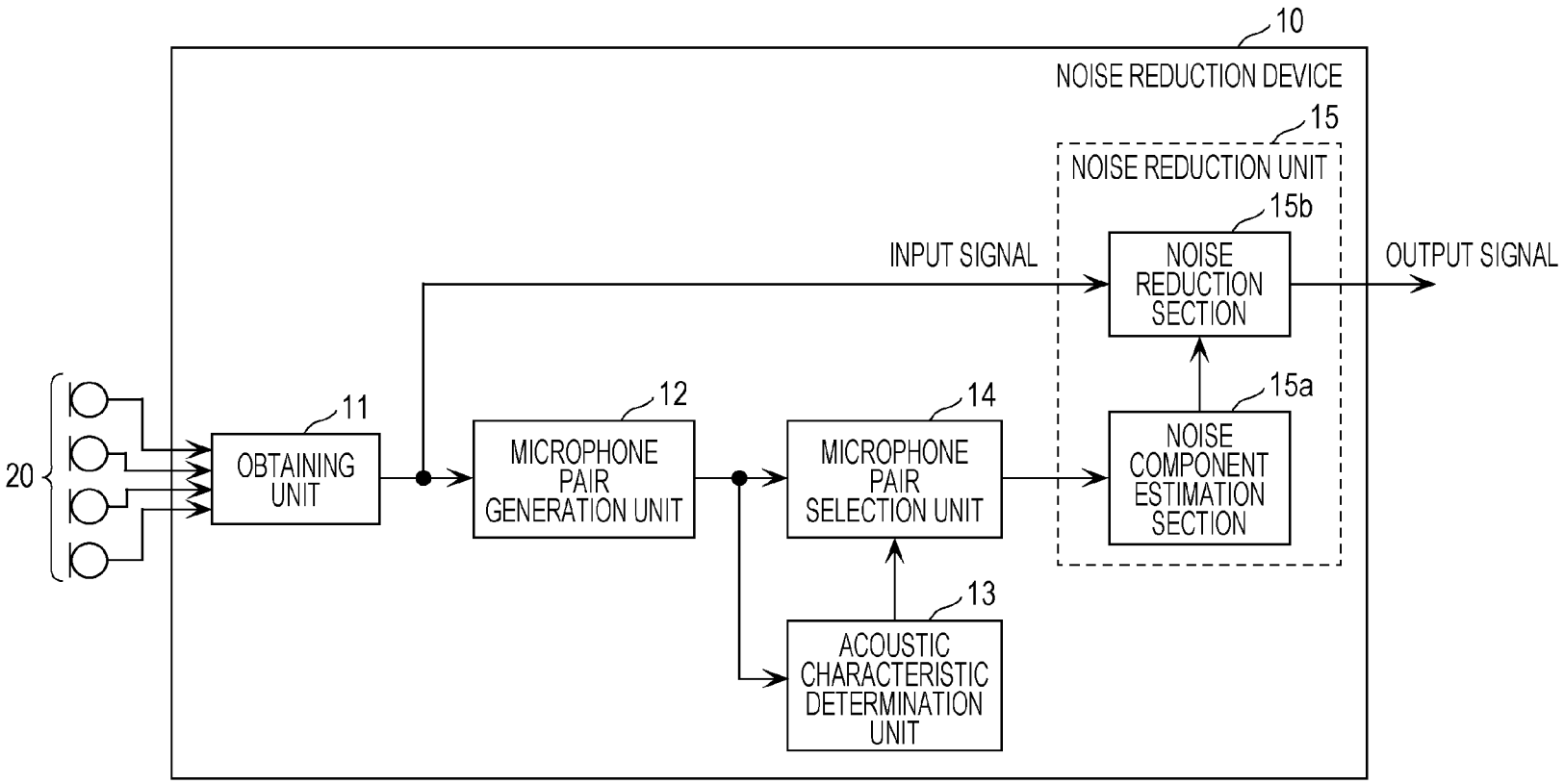
FIG. 2 is a block diagram illustrating the functional configuration of a noise reduction device according to the first embodiment.

The noise reduction device 10 according to the first embodiment enhances the noise reduction effects by selectively using microphones 20 effective in noise reduction, even if there is an obstacle around one of the plurality of microphones 20. A specific example of the noise reduction device will be described hereinafter. FIG. 2 is a block diagram illustrating the functional configuration of the noise reduction device 10.

As illustrated in FIG. 2, the noise reduction device 10 according to the first embodiment includes an obtaining unit 11, a microphone pair generation unit 12, an acoustic characteristic determination unit 13, a microphone pair selection unit 14, and a noise reduction unit 15.

The noise reduction device 10 performs signal processing for reducing noise on microphone signals output from the plurality of microphones 20 and outputs resultant signals. The noise reduction device 10 is achieved by a processor such as a digital signal processor (DSP), for example, but may be achieved by a microcomputer or a circuit, instead. Alternatively, the noise reduction device 10 may be achieved by a combination of at least two of a processor, a microcomputer, and a circuit. In this case, the components of the noise reduction device 10 may be achieved as functions of the processor or the microcomputer, or may be achieved as the circuit.

Figure 3:
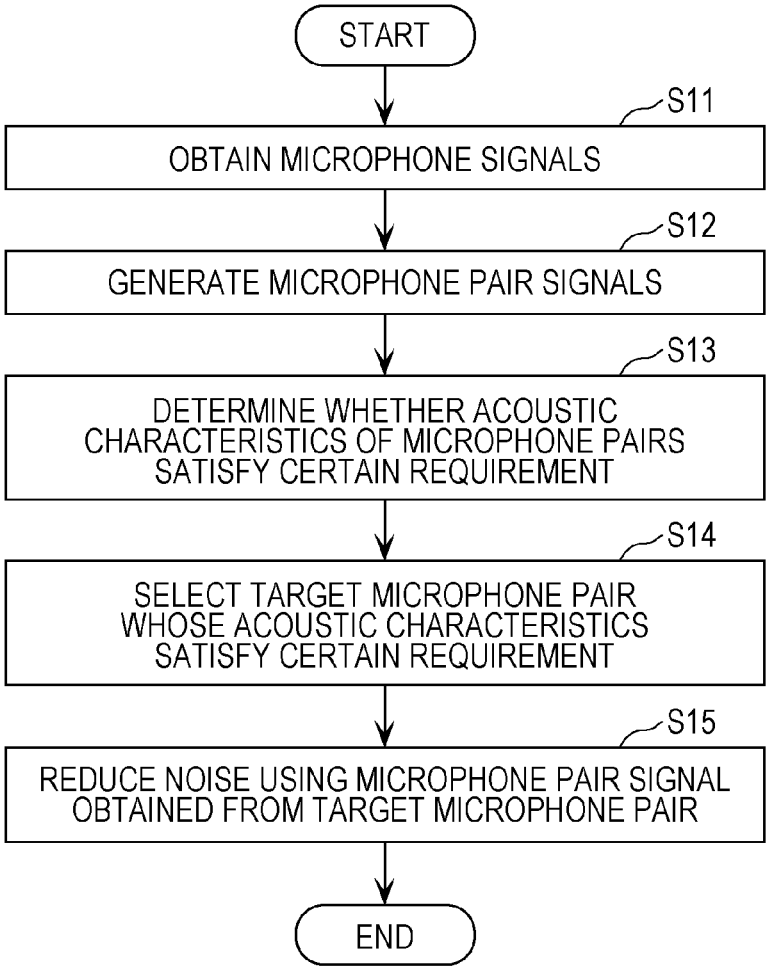
FIG. 3 is a flowchart illustrating the operation of the noise reduction device according to the first embodiment.

The components of the noise reduction device 10 will be described in detail hereinafter with reference to a flowchart of FIG. 3, as well as FIG. 2. FIG. 3 is a flowchart illustrating the operation of the noise reduction device 10.

Obtaining Unit

The obtaining unit 11 obtains microphone signals from the plurality of microphones 20 (S11 in FIG. 3). The plurality of microphones 20 are nondirective microphones. In the first embodiment, the obtaining unit 11 obtains microphone signals from four microphones 20. The number of microphones 20 is not particularly limited. The number of microphones 20 may be even or odd. The obtaining unit 11 may obtain microphone signals from, for example, five or more microphones 20, instead.

Microphone Pair Generation Unit

Figure 4:
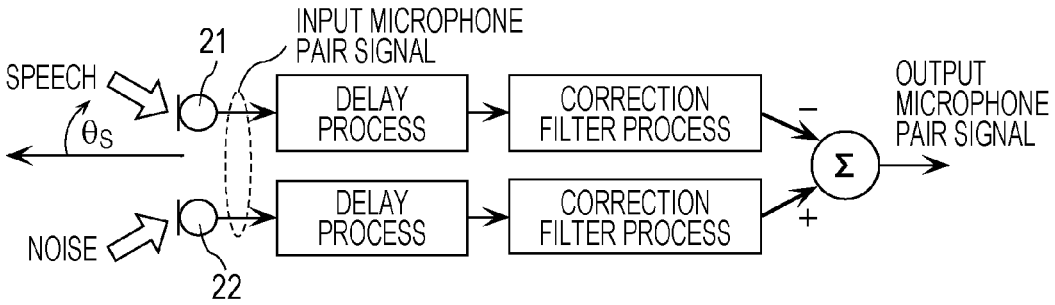
FIG. 4 is a diagram illustrating a method for generating a microphone pair signal.

The microphone pair generation unit 12 generates output microphone pair signals using input microphone pair signals obtained from microphone pairs, each of which includes arbitrary two of the plurality of microphones 20 (S12 in FIG. 3). Each output microphone pair signal is generated using an input microphone pair signal, which includes microphone signals output from two microphones 20 included in a microphone pair. The microphone pair generation unit 12 obtains the microphone signals through the obtaining unit 11. FIG. 4 is a diagram illustrating a method for generating a microphone pair signal.

FIG. 4 is a diagram illustrating an example of generation of an output microphone pair signal of a microphone pair including a first microphone 21 and a second microphone 22. The microphone pair generation unit 12 delays, for example, a first microphone signal output from the first microphone 21 by an angular difference between a direction $\theta_S$ (hereinafter also referred to as a "speech direction $\theta_S$") of a speech sound (target sound) uttered by a desired utterer and a reference direction and a second microphone signal output from the second microphone 22 by an angular difference between the speech direction $\theta_S$ and the reference direction to phase the two signals. The microphone pair generation unit 12 then performs a subtraction.

The microphone pair generation unit 12 performs the delay process and a correction filter process, for example, on the first microphone signal. More specifically, the correction filter process is a process for correcting sensitivity in the speech direction $\theta_S$ to 0 dB. The delay process may be included in the correction filter process. The microphone pair generation unit 12 also performs the delay process and the correction filter process on the second microphone signal. As a result, a speech component coming from the speech direction $\theta_S$ included in the first microphone signal becomes in phase with a speech component included in the second microphone signal. The microphone pair generation unit 12 then subtracts, for example, the first microphone signal from the second microphone signal. The output microphone pair signal is thus generated.

In the generated output microphone pair signal, the speech component coming from the speech direction $\theta_S$ is reduced, and the sensitivity of the generated microphone pair signal in the speech direction $\theta_S$ is lower than in other directions. In other words, the generated output microphone pair signal has directional characteristics in which there is a sharp blind spot in the certain speech direction $\theta_S$. An output microphone pair signal will also be referred to simply as a "microphone pair signal" in the following embodiments.

If the number of microphones 20 is four, the microphone pair generation unit 12 generates an output microphone pair signal from each of a maximum of six microphone pairs obtained from the four microphones 20.

Although a determination whether acoustic characteristics satisfy a certain condition is made for each microphone pair in the first embodiment, the determination may be made for each microphone set including three or more microphones 20, instead. In this case, the microphone pair generation unit 12 generates a microphone set signal from the microphone set using a method similar to that described with reference to FIG. 4.

Acoustic Characteristic Determination Unit

The acoustic characteristic determination unit 13 is an example of a determination unit and determines, using a generated microphone pair signal, whether acoustic characteristics of each of a plurality of microphone pairs satisfy a certain requirement (S13 in FIG. 3). The acoustic characteristic determination unit 13 determines on the basis of a signal level of a microphone pair signal whether acoustic characteristics of a microphone pair corresponding to the microphone pair signal satisfy the certain requirement.

A microphone pair signal includes a large noise component. If acoustic characteristics satisfy the certain requirement (normal condition), a signal level of a microphone pair signal is low because a speech component of an utterer is appropriately reduced (the speech component is removed and the noise component remains). If acoustic characteristics do not satisfy the certain requirement (abnormal condition), the speech component is erroneously regarded as noise, and a signal level of a microphone pair signal becomes high (the speech component is not removed and remains along with the noise component).

The acoustic characteristic determination unit 13, therefore, determines whether a signal level of a microphone pair signal is higher than a threshold (absolute signal level). If the signal level of the microphone pair signal is equal to or lower than the threshold, it is estimated that there is no obstacle around a microphone pair corresponding to the microphone pair signal. Acoustic characteristics of such a microphone pair (microphone pair signal) satisfy the certain requirement, and it is determined that the microphone pair can be used in the signal processing for reducing noise.

If the signal level of the microphone pair signal is higher than the threshold, on the other hand, it is estimated that there is an obstacle around the microphone pair corresponding to the microphone pair signal. Acoustic characteristics of such a microphone pair (microphone pair signal) do not satisfy the certain requirement, and it is determined that it is difficult to use the microphone pair in the signal processing for reducing noise.

The threshold may be determined for each microphone pair. For example, a threshold for a certain microphone pair signal is set larger than an average of past signal levels of the microphone pair signal by a first certain value.

If a signal level of a microphone pair signal is equal to or lower than the threshold in this case, the signal level of the microphone pair signal is equal to or lower than the average of the past signal levels or the signal level of the microphone pair signal is higher than the average of the past signal levels but a difference is not significant. If a signal level of a microphone pair signal is equal to or lower than the threshold, therefore, it is estimated that there is no obstacle around a microphone pair corresponding to the microphone pair signal. Acoustic characteristics of such a microphone pair (microphone pair signal) satisfy the certain requirement, and it is determined that the microphone pair can be used in the signal processing for reducing noise.

If a signal level of a microphone pair signal is higher than the threshold, on the other hand, the signal level of the microphone pair signal is significantly higher than the average of the past signal levels. If a signal level of a microphone pair signal is higher than the threshold, therefore, it is estimated that there is an obstacle around a microphone pair corresponding to the microphone pair signal. Acoustic characteristics of such a microphone pair (microphone pair signal) do not satisfy the certain requirement, and it is determined that it is difficult to use the microphone pair in the signal processing for reducing noise.

Alternatively, the threshold may be determined on the basis of a relative relationship between signal levels of a plurality of microphone pair signals. For example, a threshold for a certain microphone pair signal is set smaller than an average of signal levels of a plurality of other microphone pair signals by a second certain value.

If a signal level of a microphone pair signal is equal to or lower than the threshold in this case, the signal level of the microphone pair signal is equal to or lower than the average of the signal levels of the plurality of other microphone pair signals or the signal level of the microphone pair signal is higher than the average of the signal levels of the plurality of other microphone pair signals but a difference is not significant. If a signal level of a microphone pair signal is equal to or lower than the threshold, therefore, it is estimated that there is no obstacle around a microphone pair corresponding to the microphone pair signal. Acoustic characteristics of such a microphone pair (microphone pair signal) satisfy the certain requirement, and it is determined that the microphone pair can be used in the signal processing for reducing noise.

If a signal level of a microphone pair signal is higher than the threshold, on the other hand, the signal level of the microphone pair signal is significantly higher than the average of the signal levels of the plurality of other microphone pair signals. If a signal level of a microphone pair signal is higher than the threshold, therefore, it is estimated that there is an obstacle around a microphone pair corresponding to the microphone pair signal. Acoustic characteristics of such a microphone pair (microphone pair signal) do not satisfy the certain requirement, and it is determined that it is difficult to use the microphone pair in the signal processing for reducing noise.

The acoustic characteristic determination unit 13 may make the determination using another method. For example, the acoustic characteristic determination unit 13 may make the determination on the basis of an index indicating statistical similarity, such as correlation values between a plurality of microphone signals or the independence of a plurality of microphone signals.

Microphone Pair Selection Unit

Figure 5:
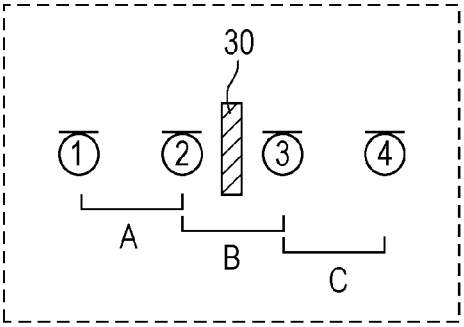
FIG. 5 is a diagram illustrating an example of the arrangement of a plurality of microphones in order to describe a first example of selection of microphone pairs.
Figure 6:
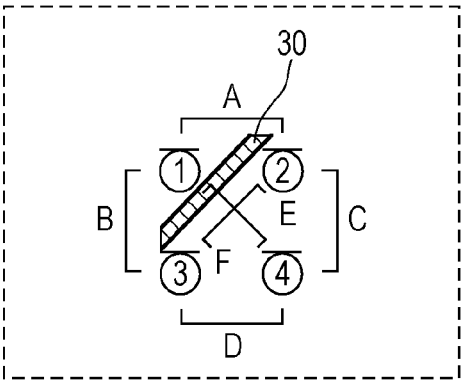
FIG. 6 is a diagram illustrating another example of the arrangement of the plurality of microphones in order to describe a second example of the selection of microphone pairs.

The microphone pair selection unit 14 obtains a result of a determination from the acoustic characteristic determination unit 13 and selects, from among a plurality of microphone pairs on the basis of the obtained result of the determination, a target microphone pair whose acoustic characteristics have been determined to satisfy the certain requirement (S14 in FIG. 3). In other words, the microphone pair selection unit 14 excludes, among the plurality of microphone pairs, a microphone pair whose acoustic characteristics have been determined to not satisfy the certain requirement. FIGS. 5 and 6 are diagrams illustrating examples of the arrangement of a plurality of microphones in order to describe examples of selection of microphone pairs. Four microphones 1 to 4 illustrated in FIGS. 5 and 6 correspond to the four microphones 20 illustrated in FIG. 2.

In the diagram of FIG. 5, microphones 1 to 4 together form a linear microphone array in which microphones 1 to 4 are arranged in a line. In this case, there can be three patterns of a microphone pair, namely microphone pairs A to C.

If there is an obstacle 30 between microphone 2 and microphone 3, which form microphone pair B, the acoustic characteristic determination unit 13 determines that acoustic characteristics of microphone pair B do not satisfy the certain requirement. The acoustic characteristic determination unit 13 determines that acoustic characteristics of microphone pairs A and C satisfy the certain requirement.

The microphone pair selection unit 14, therefore, selects microphone pairs A and C as target microphone pairs and excludes microphone pair B.

In the diagram of FIG. 6, on the other hand, microphones 1 to 4 together form a square microphone array in which microphones 1 to 4 are arranged at corners of a square. In this case, there can be six patterns of a microphone pair, namely microphone pairs A to F.

If there is an obstacle 30 between microphones 1, 2, and 3, the acoustic characteristic determination unit 13 determines that acoustic characteristics of microphone pairs A, B, and E do not satisfy the certain requirement. The acoustic characteristic determination unit 13 determines that acoustic characteristics of microphone pairs C, D, and F satisfy the certain requirement.

The microphone pair selection unit 14, therefore, selects microphone pairs C, D, and F as target microphone pairs and excludes microphone pairs A, B, and E.

The microphone pair selection unit 14 obtains, from the microphone pair generation unit 12, microphone pair signals of target microphone pairs selected in the above manner and outputs the microphone pair signals to the noise reduction unit 15.

Noise Reduction Unit

The noise reduction unit 15 receives, as an input signal, a microphone signal obtained from at least one of microphone signals output from the plurality of microphones 20 using a microphone pair signal obtained from a target microphone pair and reduces noise included in the input signal (S15 in FIG. 3). The noise reduction unit 15 excludes microphone pair signals obtained from microphone pairs other than the target microphone pair and does not use the microphone pair signals in the reduction of noise. A signal obtained by reducing noise included in the input signal is output as an output signal.

The noise reduction unit 15 is, for example, a beamformer (a sidelobe canceler, a sidelobe suppressor, or the like) and performs beamforming using a microphone pair signal obtained from a target microphone pair as a reference signal. More specifically, the noise reduction unit 15 includes a noise component estimation section 15*a* and a noise reduction section 15*b*.

The noise component estimation section 15*a* generates a noise estimation signal by multiplying a microphone pair signal obtained from each target microphone pair by a filter coefficient. The filter coefficient is repeatedly updated in accordance with output signals.

The noise reduction section 15*b* reduces noise included in an input signal by subtracting a noise estimation signal from the input signal. The input signal whose noise has been reduced is output as an output signal. An input signal is, for example, one of a plurality of microphone signals obtained by the obtaining unit 11.

Advantageous Effects

As described above, the noise reduction device 10 includes the acoustic characteristic determination unit 13, the microphone pair selection unit 14, and the noise reduction unit 15. The acoustic characteristic determination unit 13 determines, using each of microphone pair signals obtained from a plurality of microphone pairs, each of which includes arbitrary two of the plurality of microphones 20, whether acoustic characteristics of one of the plurality of microphone pairs corresponding to the microphone pair signal satisfy the certain requirement. The microphone pair selection unit 14 selects, from among the plurality of microphone pairs, a microphone pair whose acoustic characteristics have been determined to satisfy the certain requirement as a target microphone pair. The noise reduction unit 15 reduces, using a microphone pair signal obtained from the target microphone pair, noise included in an input signal obtained from at least one of the microphone pair signals output from the plurality of microphones 20.

The noise reduction device 10 excludes a microphone pair whose acoustic characteristics do not satisfy the certain requirement because there is an obstacle around the microphone pair, and reduces noise by selectively using microphone pairs effective in reducing noise. That is, the noise reduction device 10 can effectively reduce noise.

First Modification: Microphone Selection Unit

Figure 7:
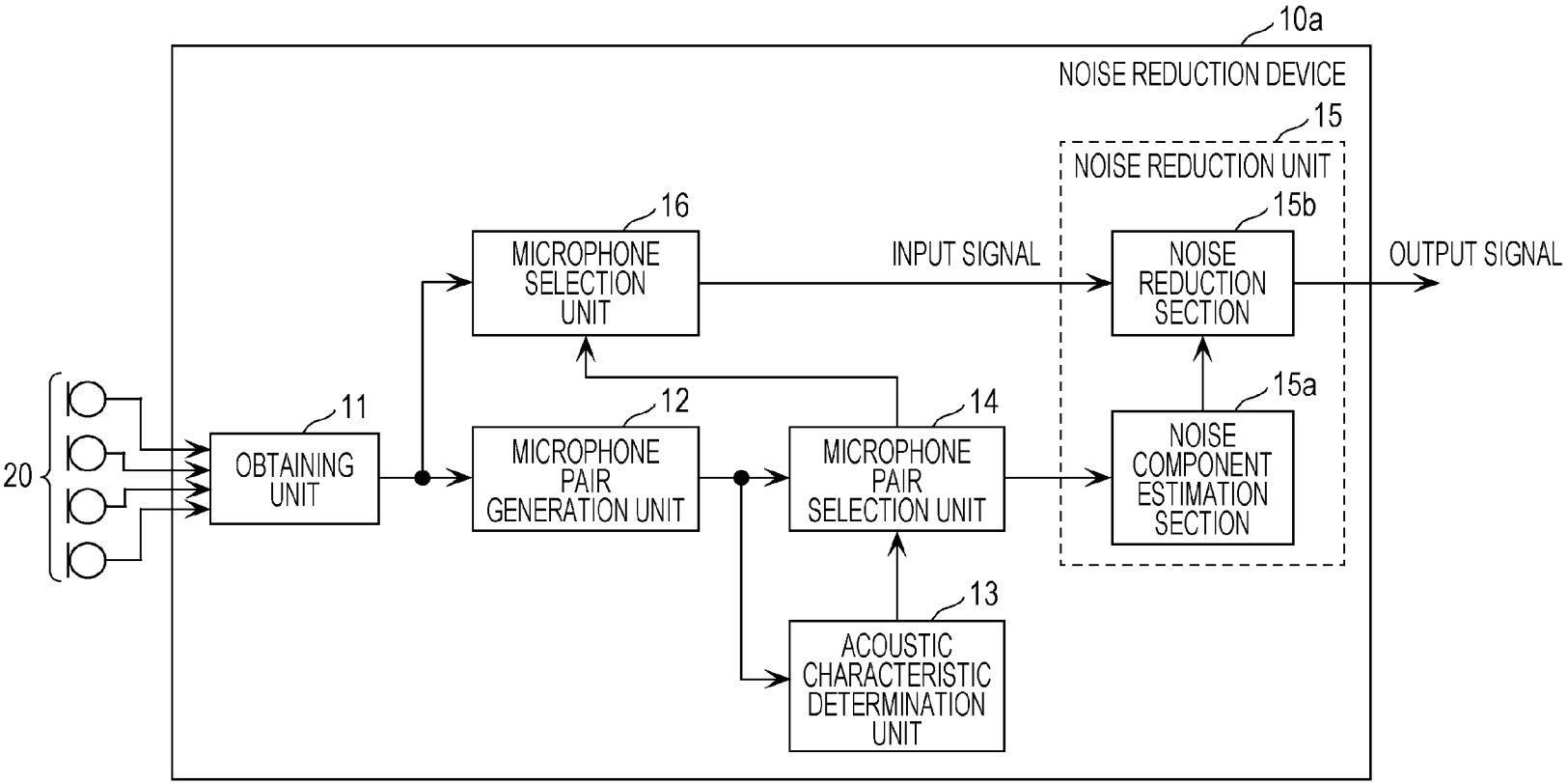
FIG. 7 is a block diagram illustrating an example of the functional configuration of a noise reduction device according to a first modification of the first embodiment.

The noise reduction device 10 may further include a microphone selection unit 16 that selects, from among the plurality of microphones 20, target microphones included in a target microphone pair. FIG. 7 is a block diagram illustrating an example of the functional configuration of a noise reduction device 10*a* according to a first modification.

The noise reduction device 10*a* illustrated in FIG. 7 is different from the noise reduction device 10 in that the noise reduction device 10*a* further includes the microphone selection unit 16. The microphone selection unit 16 selects, from among the plurality of microphones 20, target microphones included in a target microphone pair.

In the diagram of FIG. 5, microphone pairs A and C are selected as target microphone pairs, which means that microphones 1 to 4 are all included in the target microphone pairs. The microphone selection unit 16, therefore, selects microphones 1 to 4 as target microphones. In this case, no microphone is excluded.

In the diagram of FIG. 6, microphone pairs C, D, and F are selected as target microphone pairs, which means that microphones 2 to 4 are included in the target microphone pairs but microphone 1 is not included in any target microphone pair. The microphone selection unit 16, therefore, selects microphones 2 to 4 as target microphones and excludes microphone 1.

As described above, the noise reduction unit 15 uses, for example, one of a plurality of microphone signals obtained by the obtaining unit 11 as an input signal. If a microphone signal output from a microphone 20 that is not included in any target microphone pair, that is, a microphone signal output from a microphone other than target microphones, is used as an input signal, sufficient noise reduction effects might not be produced.

In the noise reduction device 10*a*, therefore, the noise reduction unit 15 uses a microphone signal obtained from a target microphone as an input signal and reduces noise included in the input signal. As a result, the noise reduction device 10*a* can effectively reduce noise.

Figure 8:
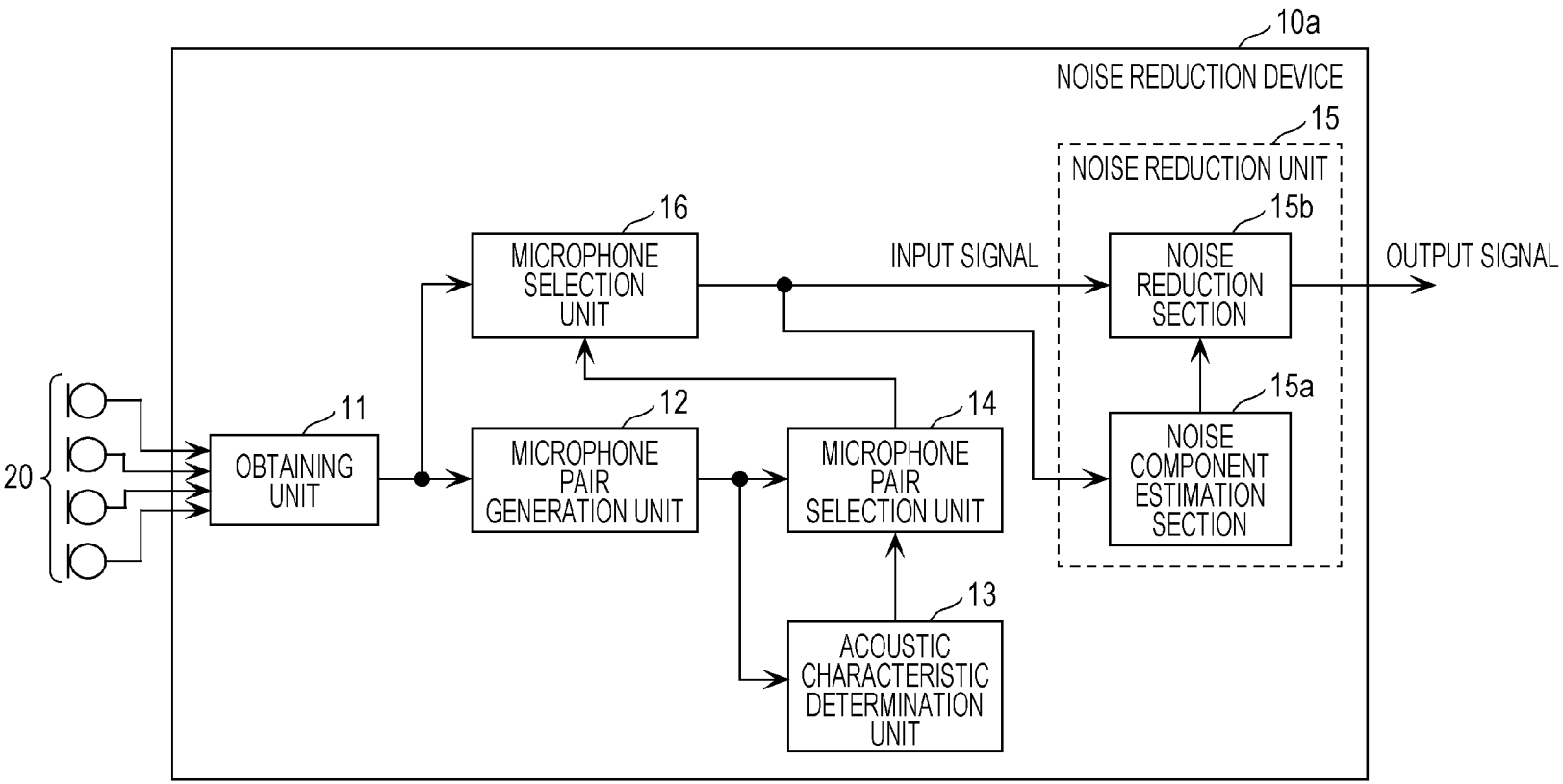
FIG. 8 is a block diagram illustrating another example of the functional configuration of the noise reduction device according to the first modification of the first embodiment.

The configuration illustrated in FIG. 7 is an example, and the noise reduction device 10*a* may be configured as illustrated in FIG. 8. FIG. 8 is a diagram illustrating another example of the functional configuration of the noise reduction device 10*a*.

In FIG. 8, the noise reduction unit 15 obtains microphone signals of target microphones from the microphone selection unit 16 instead of obtaining a microphone pair signal of a target microphone pair from the microphone pair selection unit 14. The noise component estimation section 15*a* generates a microphone pair signal of a microphone pair including two target microphones. The operation of the noise reduction unit 15 thereafter is the same as in the configuration illustrated in FIG. 7.

Second Embodiment: Amplification Unit

Figure 9:
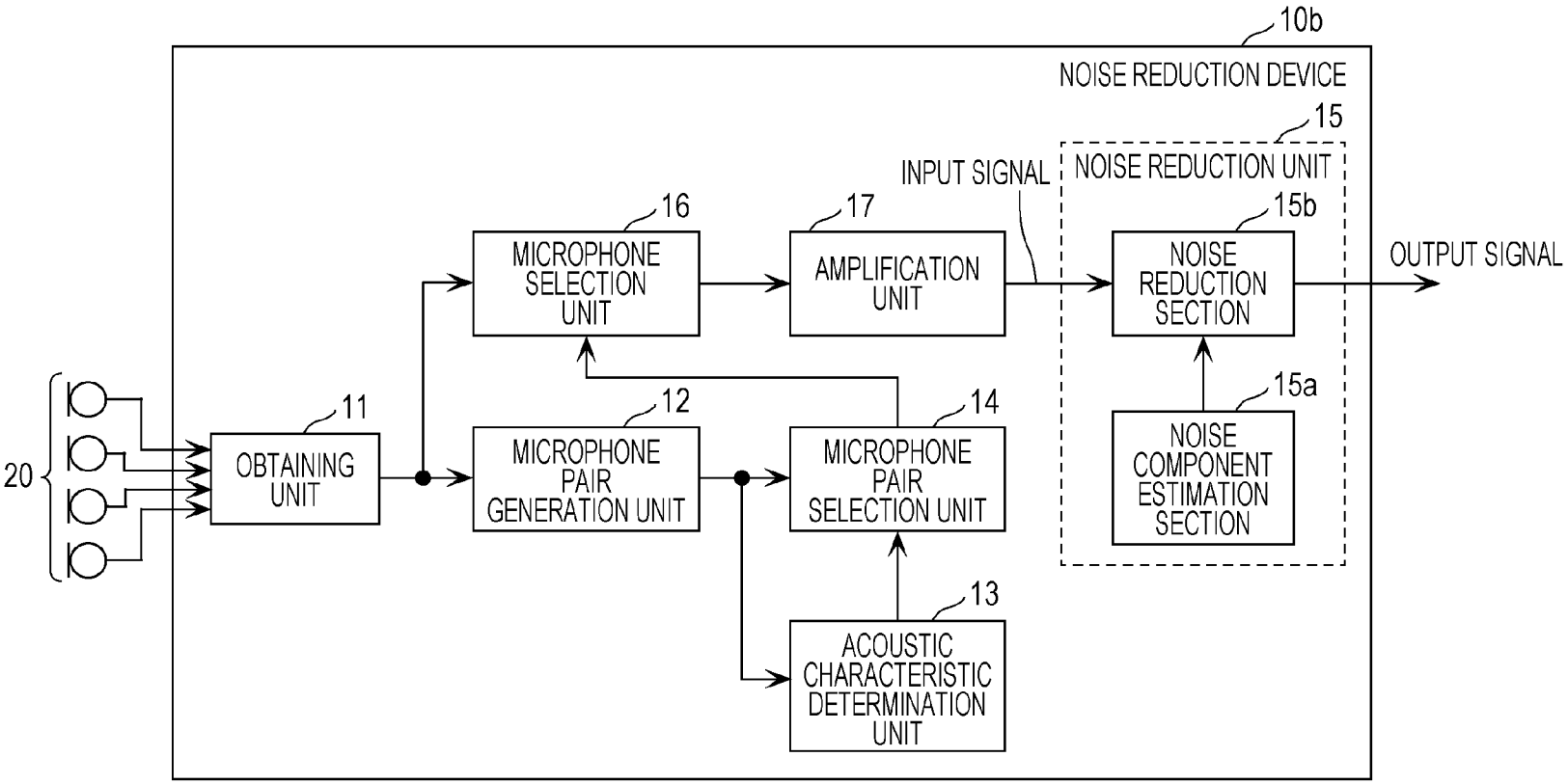
FIG. 9 is a block diagram illustrating the functional configuration of a noise reduction device according to a second modification of the first embodiment.

The noise reduction device 10 or 10*a* may further include an amplification unit 17 that generates an input signal in which a speech component of the utterer coming from a certain direction is amplified using microphone signals obtained from two or more microphones 20. FIG. 9 is a block diagram illustrating the functional configuration of a noise reduction device 10*b* according to a second modification.

The noise reduction device 10*b* illustrated in FIG. 9 is obtained by adding the amplification unit 17 to the noise reduction device 10*a*, which includes the microphone selection unit 16. Alternatively, the amplification unit 17 may be added to the noise reduction device 10, which does not include the microphone selection unit 16, or to any of noise reduction devices described later.

Figure 10:
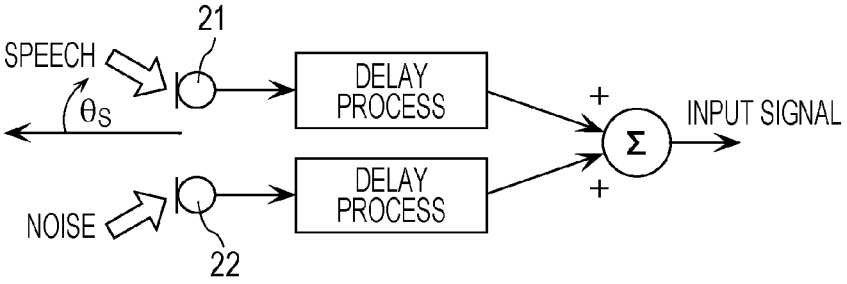
FIG. 10 is a diagram illustrating a method for generating an input signal used by an amplification unit.

The amplification unit 17 generates an input signal in which a speech component of the utterer coming from a certain direction using microphone signals obtained from two or more microphones 20. FIG. 10 is a diagram illustrating a method for generating an input signal used by the amplification unit 17.

FIG. 10 is a diagram illustrating an example in which an input signal is generated using the first microphone signal output from the first microphone 21 and the second microphone signal output from the second microphone 22. For example, the amplification unit 17 phases the first microphone signal and a speech signal indicating a speech sound of the utterer coming from the speech direction $\theta_S$ with each other. The amplification unit 17 delays the first microphone signal. The amplification unit 17 phases the second microphone signal and the speech signal with each other. The amplification unit 17 delays the second microphone signal.

The amplification unit 17 then combines the delayed first microphone signal and the delayed second microphone signal with each other. As a result, an input signal is generated.

In the generated input signal, a signal level of the speech component coming from the speech direction $\theta_S$ has been relatively increased. That is, in the input signal, the speech component coming from the speech direction $\theta_S$ is amplified. In other words, the directivity of the generated input signal is increased in the certain speech direction $\theta_S$.

If the obtaining unit 11 obtains four microphone signals, the amplification unit 17 delays the four microphone signals and combines the delayed four microphone signals together. Here, if a microphone signal output from a microphone other than target microphones selected by the microphone selection unit 16 is added, sufficient noise reduction effects might not be produced.

The amplification unit 17, therefore, generates an input signal by selectively using only target microphones. That is, the amplification unit 17 generates an input signal using microphone signals obtained from two or more target microphones. As a result, the noise reduction device 10*b* can effectively reduce noise.

Second Embodiment

Configuration of Noise Reduction Device According to Second Embodiment

Figure 11:
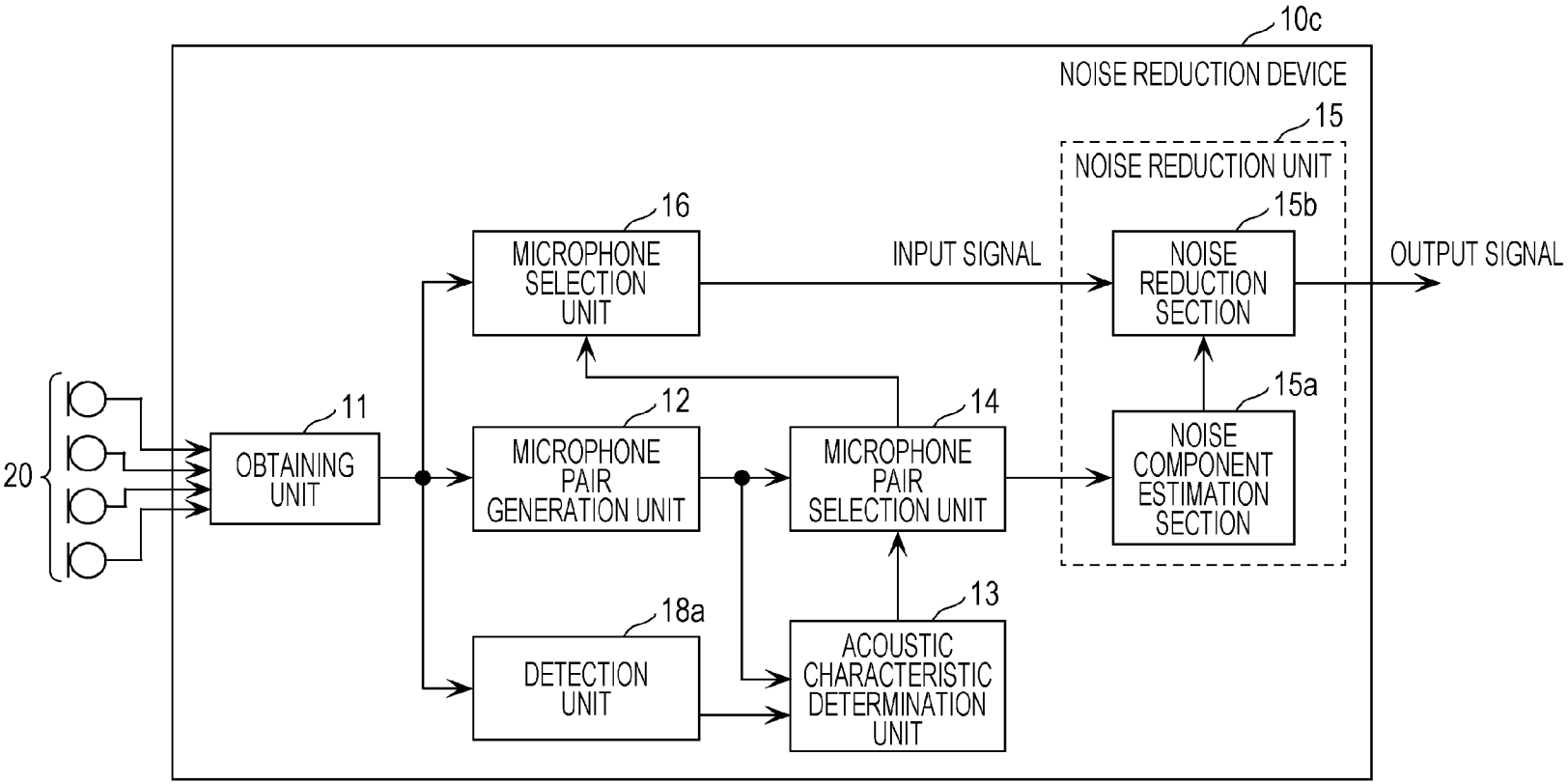
FIG. 11 is a block diagram illustrating the functional configuration of a noise reduction device according to a second embodiment.

If a speech sound input to the plurality of microphones 20 is small, the accuracy of a determination made by the acoustic characteristic determination unit 13 might decrease. The noise reduction device 10, therefore, may include a detection unit 18*a* that detects a speech sound having a certain level of volume input to the plurality of microphones 20. FIG. 11 is a block diagram illustrating the functional configuration of a noise reduction device 10*c* according to a second embodiment.

The noise reduction device 10*c* illustrated in FIG. 11 is obtained by adding the detection unit 18*a* to the noise reduction device 10*a*. Alternatively, the detection unit 18*a* may be added to the noise reduction device 10 or the like.

The detection unit 18*a* detects a target period for which sound levels of microphone signals obtained by the obtaining unit 11 and output from the plurality of microphones 20 are higher than a certain level. In other words, the detection unit 18*a* detects a target period for which a speech sound having a certain level of volume is input to the plurality of microphones 20.

More specifically, for example, the detection unit 18*a* may detect, as a target period, a period for which an average of signal levels of a plurality of microphone signals is higher than the certain level or a period for which a highest one of signal levels of a plurality of microphone signals is higher than the certain level.

The acoustic characteristic determination unit 13 makes a determination using microphone pair signals obtained from a plurality of microphone pairs in a target period detected by the detection unit 18*a*. As a result, the accuracy of a determination made by the acoustic characteristic determination unit 13 increases.

First Modification of Second Embodiment

Figure 12:
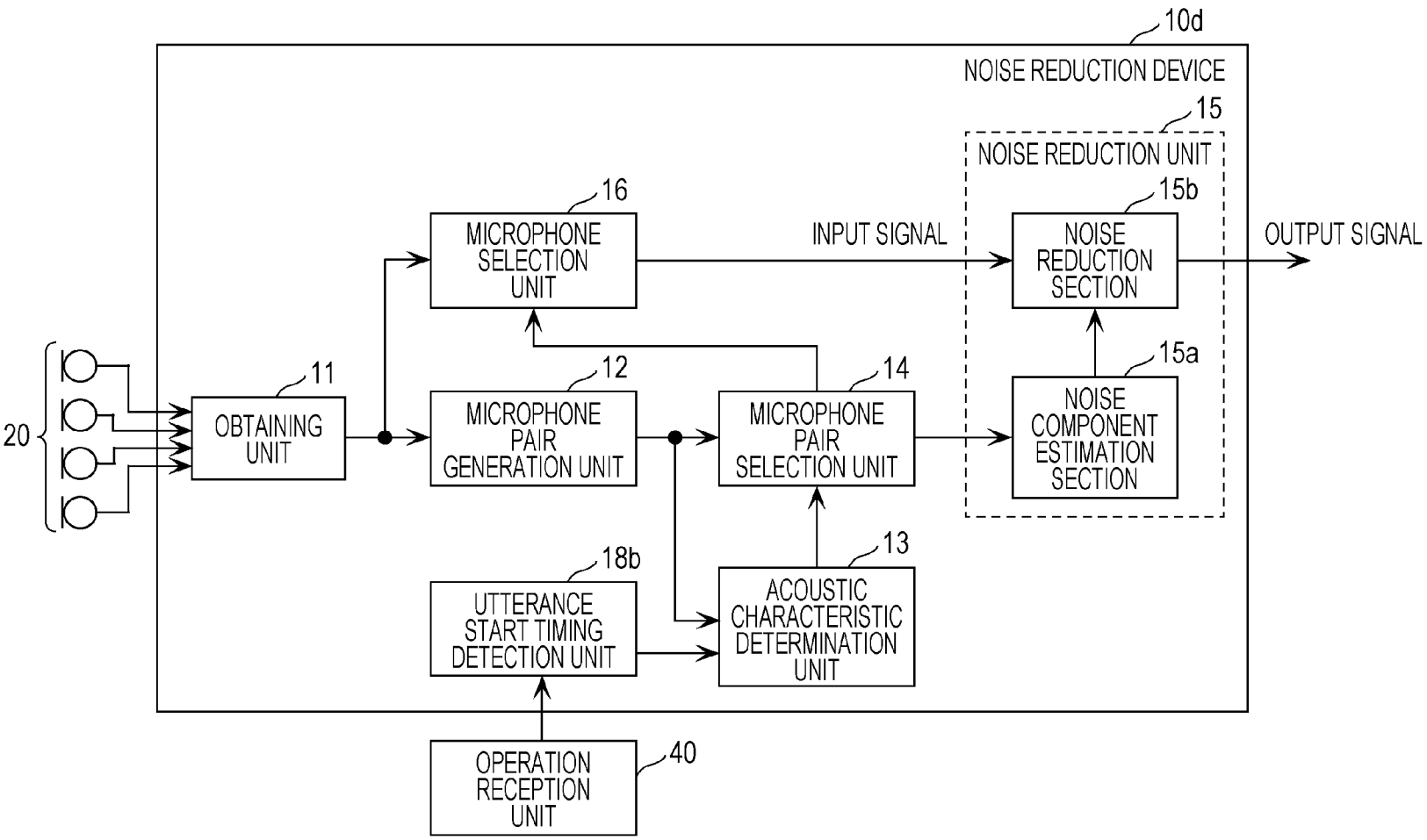
FIG. 12 is a block diagram illustrating the functional configuration of a noise reduction device according to a first modification of the second embodiment.

When the noise reduction device 10 is used for the automatic translation apparatus 100, or when the noise reduction device 10 is used for an information terminal having a speech recognition function, such as a smartphone having a speech recognition function, for example, the user might perform an operation, such as pressing a button, before uttering a speech sound. In this case, the noise reduction device 10 may include a utterance start timing detection unit 18*b* that detects an operation performed by the user before the user utters a speech sound. FIG. 12 is a block diagram illustrating the functional configuration of a noise reduction device 10*d* according to a first modification of the second embodiment.

The noise reduction device 10*d* illustrated in FIG. 12 is obtained by adding the utterance start timing detection unit 18*b* to the noise reduction device 10*a*. Alternatively, the utterance start timing detection unit 18*b* may be added to the noise reduction device 10 or the like.

In the example illustrated in FIG. 12, the user begins to utter a speech sound after performing an operation on an operation reception unit 40. The utterance start timing detection unit 18*b* detects, as an utterance start timing, a timing at which the operation reception unit 40 has received the operation performed by the user before the user begins to utter the speech sound and transmits the utterance start timing to the acoustic characteristic determination unit 13. For example, upon receiving the operation, the operation reception unit 40 outputs a signal, and the utterance start timing detection unit 18*b* detects the output signal. The operation reception unit 40 is a hardware button, for example, but may be a touch panel or the like.

The user is expected to utter a speech sound immediately after performing such an operation. It is therefore expected that a speech sound having a certain level of volume will be input to the plurality of microphones 20 immediately after the operation, that is, immediately after a detected utterance start timing. The acoustic characteristic determination unit 13 makes a determination using microphone pair signals obtained from a plurality of microphone pairs after the detected utterance start timing. As a result, the accuracy of a determination made by the acoustic characteristic determination unit 13 increases.

Second Modification of Second Embodiment

Figure 13:
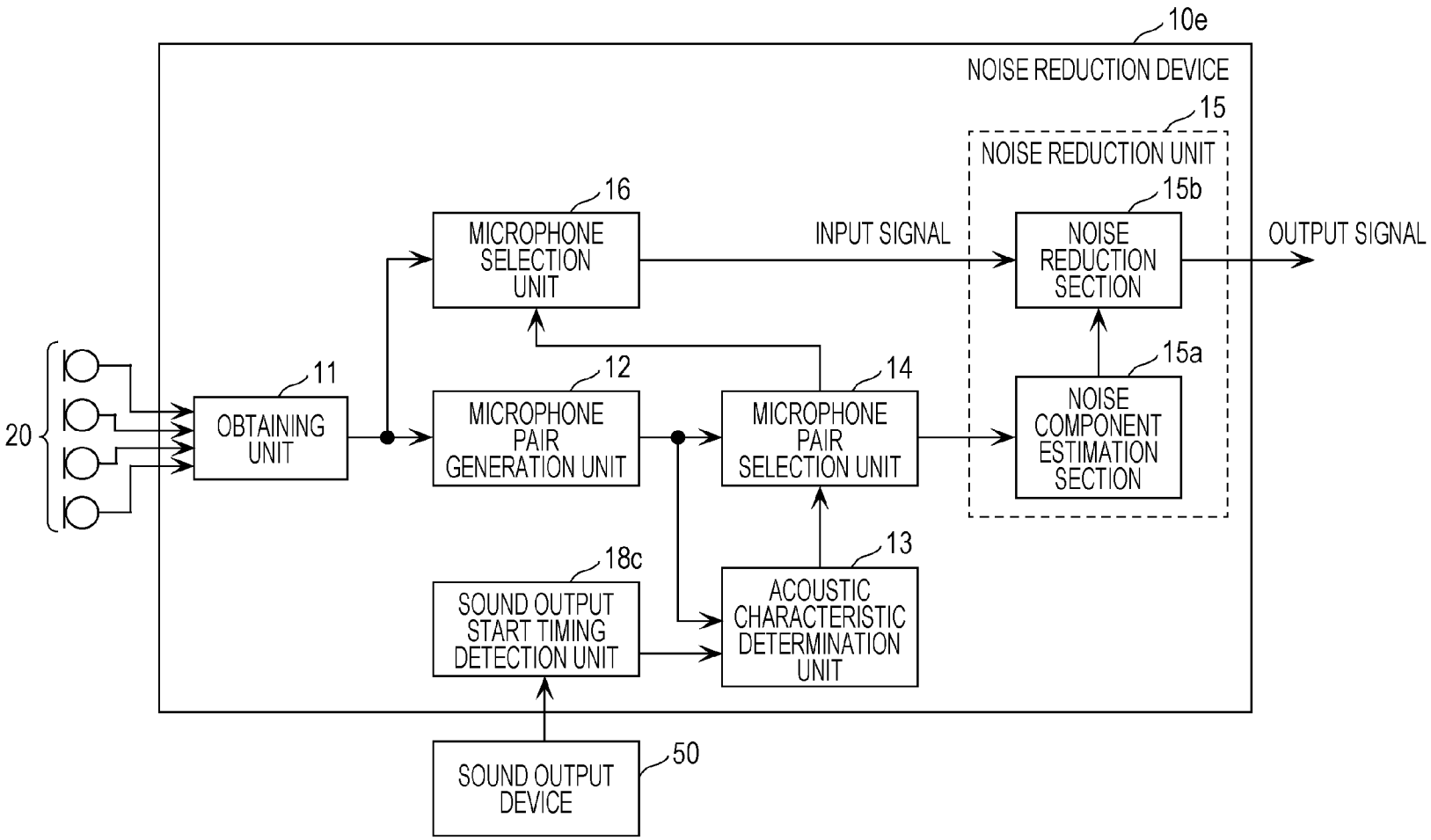
FIG. 13 is a block diagram illustrating the functional configuration of a noise reduction device according to a second modification of the second embodiment.

When the noise reduction device 10 is used for the automatic translation apparatus 100, for example, the automatic translation apparatus 100 includes a sound output device 50 that outputs a translated speech sound. More specifically, the sound output device 50 is a speaker and arranged around the plurality of microphones 20. In this case, the noise reduction device 10 may include a sound output start timing detection unit 18*c* that detects a sound output start timing of the sound output device 50. FIG. 13 is a block diagram illustrating the functional configuration of a noise reduction device 10*e* according to a second modification of the second embodiment.

The noise reduction device 10*e* illustrated in FIG. 13 is obtained by adding the sound output start timing detection unit 18*c* to the noise reduction device 10*a*. Alternatively, the sound output start timing detection unit 18*c* may be added to the noise reduction device 10 or the like.

When the sound output device 50 begins to output a speech sound, the sound output start timing detection unit 18*c* detects this as a sound output start timing and transmits the sound output start timing to the acoustic characteristic determination unit 13. For example, when beginning to output a sound, the sound output device 50 outputs a signal, and the sound output start timing detection unit 18*c* detects the output signal.

The sound output device 50 outputs a translated speech sound immediately after such a sound output start timing. It is therefore expected that a speech sound having a certain level of volume will be input to the plurality of microphones 20 immediately after the detected sound output start timing. The acoustic characteristic determination unit 13 therefore makes a determination using microphone pair signals obtained from a plurality of microphone pairs after the detected sound output start timing. As a result, the accuracy of the determination made by the acoustic characteristic determination unit 13 increases.

Third Embodiment

Configuration of Noise Reduction Device According to Third Embodiment

The noise reduction device 10 constantly outputs signals, for example, by processing microphone signals obtained by the obtaining unit 11 in real-time. If it is determined in this case that acoustic characteristics of a microphone pair do not satisfy the certain requirement, noise included in a signal output immediately after the determination might not be sufficiently reduced.

When the noise reduction device 10 is used for the automatic translation apparatus 100, for example, it might be determined, while a signal corresponding to a sentence uttered by the user is being output, that acoustic characteristics of a microphone pair do not satisfy the certain requirement, and noise might be reduced using other microphone pairs. In this case, noise included in a signal corresponding to a beginning of the sentence might be reduced using the microphone pair whose acoustic characteristics do not satisfy the certain requirement, and the amount of noise reduced might be insufficient. Noise included in a signal corresponding to a later part of the sentence, on the other hand, is reduced with the microphone pair whose acoustic characteristics do not satisfy the certain requirement excluded, and a clear signal is output. As a result, omission of a beginning of a speech sound might occur, and speech recognition for the output signal might fail.

Figure 14:
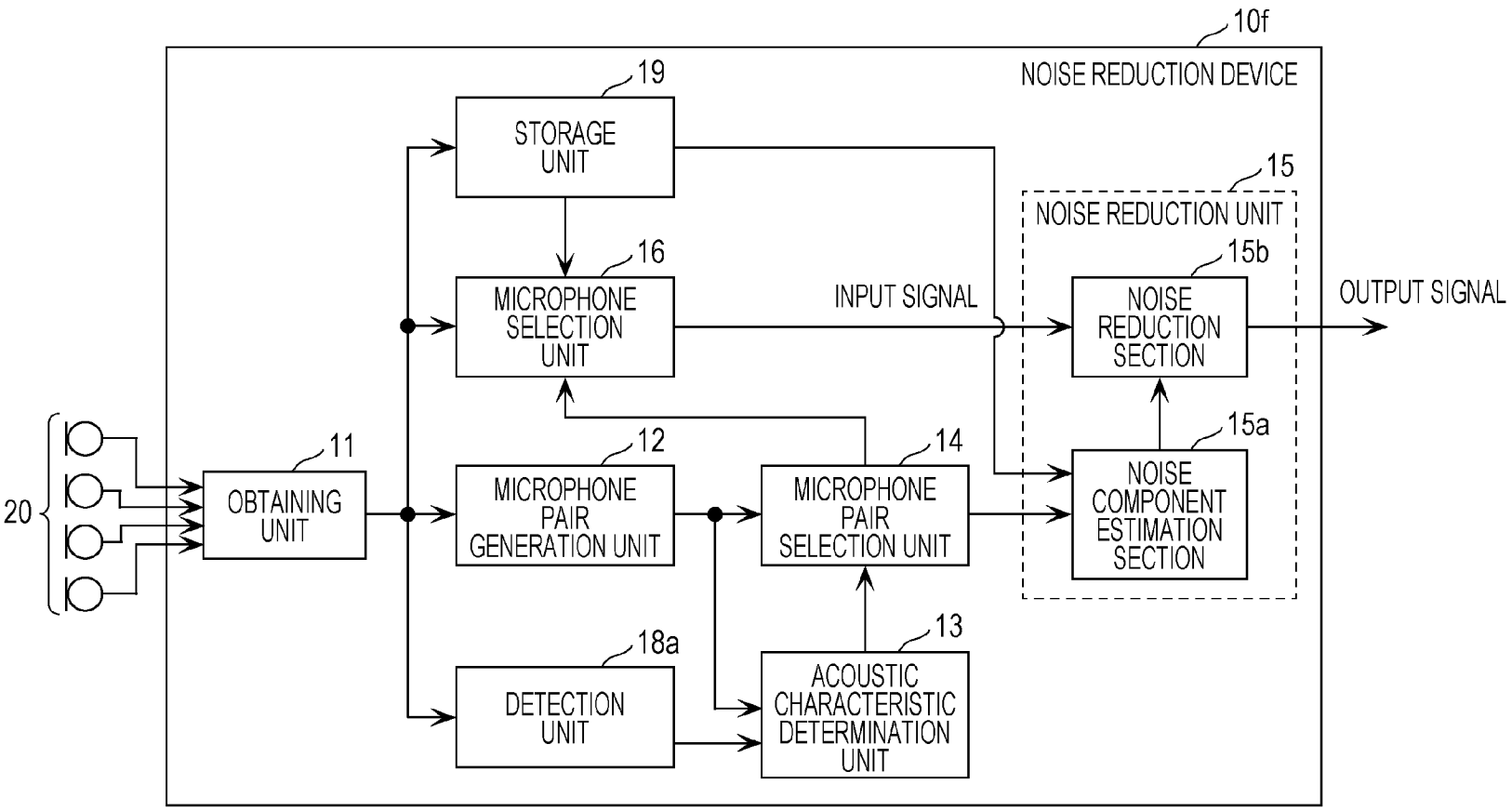
FIG. 14 is a block diagram illustrating an example of the functional configuration of a noise reduction device according to a third embodiment.

If the acoustic characteristic determination unit 13 determines that acoustic characteristics of at least one of a plurality of microphone pairs do not satisfy the certain requirement (hereinafter also referred to as an "unsatisfactory result"), therefore, the noise reduction device 10 may perform noise reduction again on past microphone signals stored in a storage unit 19. FIG. 14 is a block diagram illustrating an example of the functional configuration of a noise reduction device 10*f* according to a third embodiment.

The noise reduction device 10*f* illustrated in FIG. 14 is obtained by adding the storage unit 19 to the noise reduction device 10*c*. Alternatively, the storage unit 19 may be added to any of the above-described noise reduction devices including the noise reduction device 10.

Microphone signals obtained by the obtaining unit 11 are accumulated in the storage unit 19. More specifically, the storage unit 19 is achieved by a semiconductor memory or the like.

The acoustic characteristic determination unit 13 makes a determination using microphone pair signals obtained from a plurality of microphone pairs in a target period detected by the detection unit 18*a*. It is assumed that an unsatisfactory result is obtained at a certain time point in a target period. In this case, the microphone selection unit 16 reads, from the storage unit 19, one of microphone signals output from target microphones before a beginning of the target period and outputs the microphone signal to the noise component estimation section 15*a* of the noise reduction unit 15 as an input signal. The input signal will also be referred to as an "input signal at a beginning of a target period".

The noise component estimation section 15*a* of the noise reduction unit 15 reads, from the storage unit 19, microphone signals at a beginning of the target period output from microphones 20 included in target microphone pairs selected by the microphone pair selection unit 14 on the basis of the determination made by the acoustic characteristic determination unit 13 to generate microphone pair signals. The generated microphone pair signals will also be referred to as "microphone pair signals at a beginning of a target period".

The noise component estimation section 15*a* then multiplies the microphone pair signals at the beginning of the target period by a filter coefficient to generate noise estimation signals at the beginning of the target period. The filter coefficient is, for example, repeatedly updated in accordance with output signals. The noise reduction section 15*b* reduces noise included in input signals at the beginning of the target period by subtracting the noise estimation signals at the beginning of the target period from the input signals. The input signals whose noise has been reduced are output as output signals at the beginning of the target period. Microphone signals are then read from the storage unit 19 in chronological order, and the same process is performed.

As described above, if the acoustic characteristic determination unit 13 obtains an unsatisfactory result, which indicates that acoustic characteristics of at least one of a plurality of microphone pairs do not satisfy the certain requirement, the noise reduction unit 15 reduces noise included in an input signal obtained from at least one of microphone signals output form the plurality of microphones 20 and stored in the storage unit 19 before the unsatisfactory result is obtained. As a result, omission of a beginning of a speech sound and an abnormal sound due to discontinuity of a speech sound are suppressed.

Figure 15:
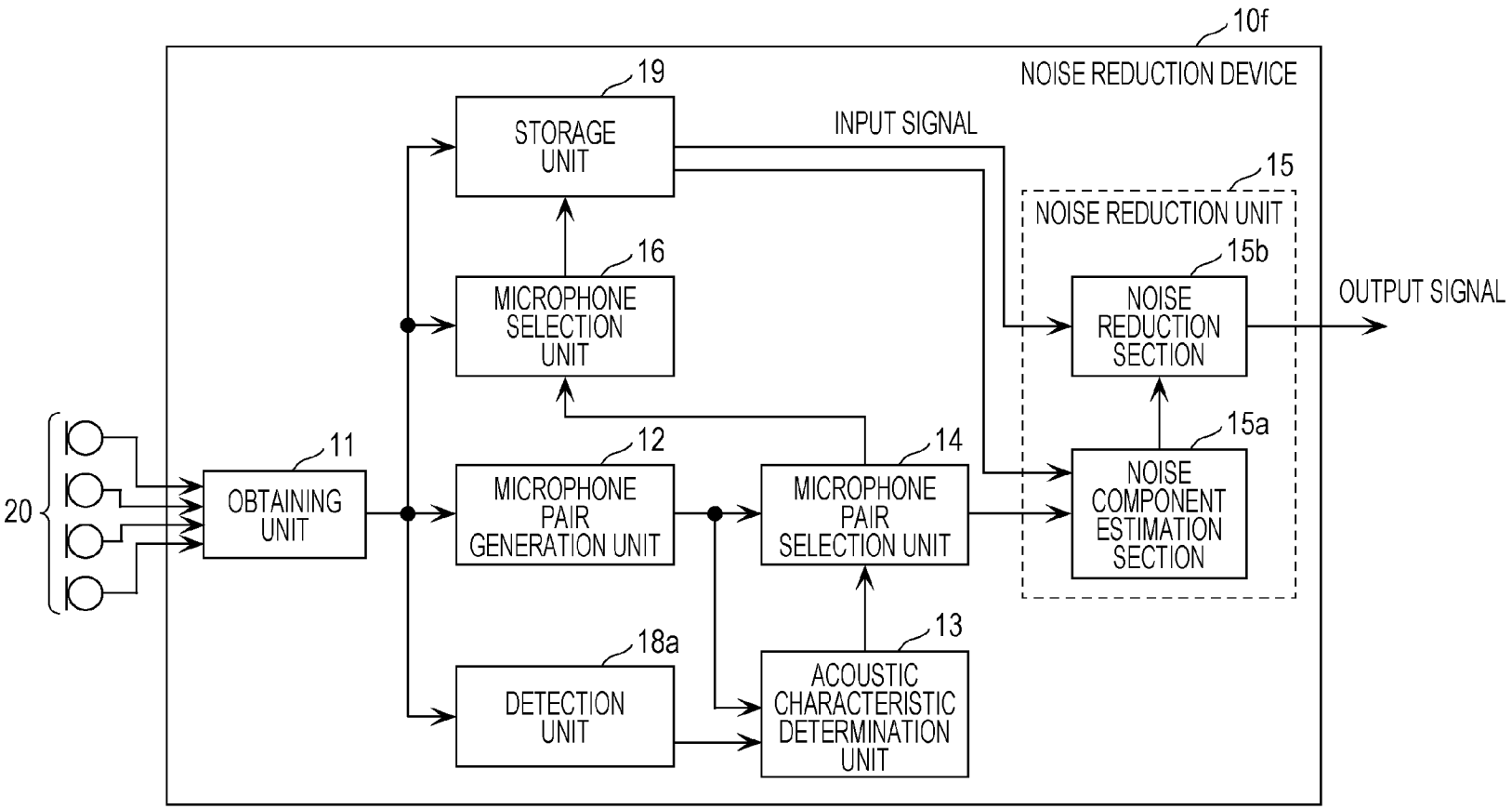
FIG. 15 is a block diagram illustrating another example of the functional configuration of the noise reduction device according to the third embodiment.

The configuration illustrated in FIG. 14 is an example, and the noise reduction device 10*f* may be configured as illustrated in FIG. 15, instead. FIG. 15 is a diagram illustrating another example of the functional configuration of the noise reduction device 10*f*.

In FIG. 15, the microphone selection unit 16 does not output an input signal. Instead, the storage unit 19 receives an instruction from the microphone selection unit 16 and outputs an input signal at a beginning of a target period. Other operations are the same as in the configuration illustrated in FIG. 14.

Alternatively, in the noise reduction device 10*f*, for example, output signals may be basically delayed for a certain period of time and then output by temporarily accumulating microphone signals obtained by the obtaining unit 11 in the storage unit 19 and then starting signal processing. In this case, if first output signals whose noise has been reduced before an unsatisfactory result is obtained have not been output due to the delay for the certain period of time, the noise reduction device 10*f* may, after the unsatisfactory result is obtained, output second output signals whose noise has been reduced using only target microphone pairs, instead of the first output signals. The certain period of time may be dynamically changed insofar as the certain period of time is equal to or shorter than a time length of microphone signals that can be accumulated in the storage unit 19.

Fourth Embodiment

Configuration of Noise Reduction Device According to Fourth Embodiment

Figure 16:
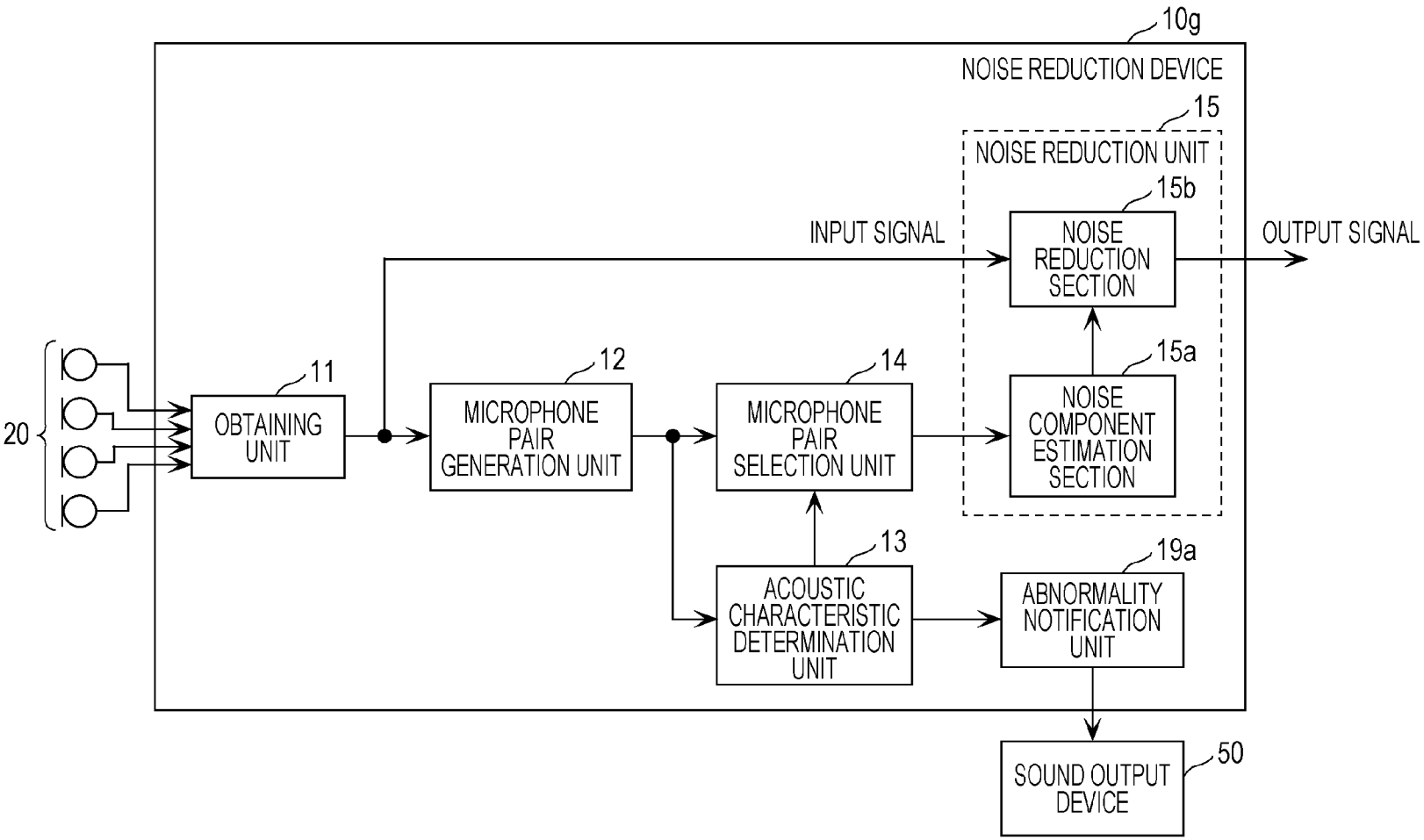
FIG. 16 is a block diagram illustrating the functional configuration of a noise reduction device according to a fourth embodiment.

As described above, if the acoustic characteristic determination unit 13 determines that there is a microphone pair whose acoustic characteristics do not satisfy the certain requirement, it is estimated that there is an abnormality, that is, there is an obstacle around the microphone pair. The noise reduction device 10, therefore, may include an abnormality notification unit 19*a* that notifies the user of an abnormality. FIG. 16 is a block diagram illustrating the functional configuration of a noise reduction device 10*g* according to a fourth embodiment.

The noise reduction device 10*g* illustrated in FIG. 16 is obtained by adding the abnormality notification unit 19*a* to the noise reduction device 10. Alternatively, the abnormality notification unit 19*a* may be added to the noise reduction device 10*a* or the like.

The abnormality notification unit 19*a* notifies the user of an abnormality on the basis of a result of a determination made by the acoustic characteristic determination unit 13. If the acoustic characteristic determination unit 13 determines that there is a microphone pair whose acoustic characteristics do not satisfy the certain requirement, for example, the abnormality notification unit 19*a* outputs a control signal to the sound output device 50 to cause the sound output device 50 to output a message for notifying the user of an abnormality. The message for notifying the user of an abnormality is, for example, a message for prompting the user to check whether there is an obstacle around the plurality of microphones 20. When the abnormality notification unit 19*a* is used for an apparatus including a display unit, the abnormality notification unit 19*a* may output a control signal to the display unit to display an image for notifying the user of an abnormality.

With the abnormality notification unit 19*a*, the noise reduction device 10*g* can notify the user of an abnormality.

First Modification of Fourth Embodiment

Figure 17:
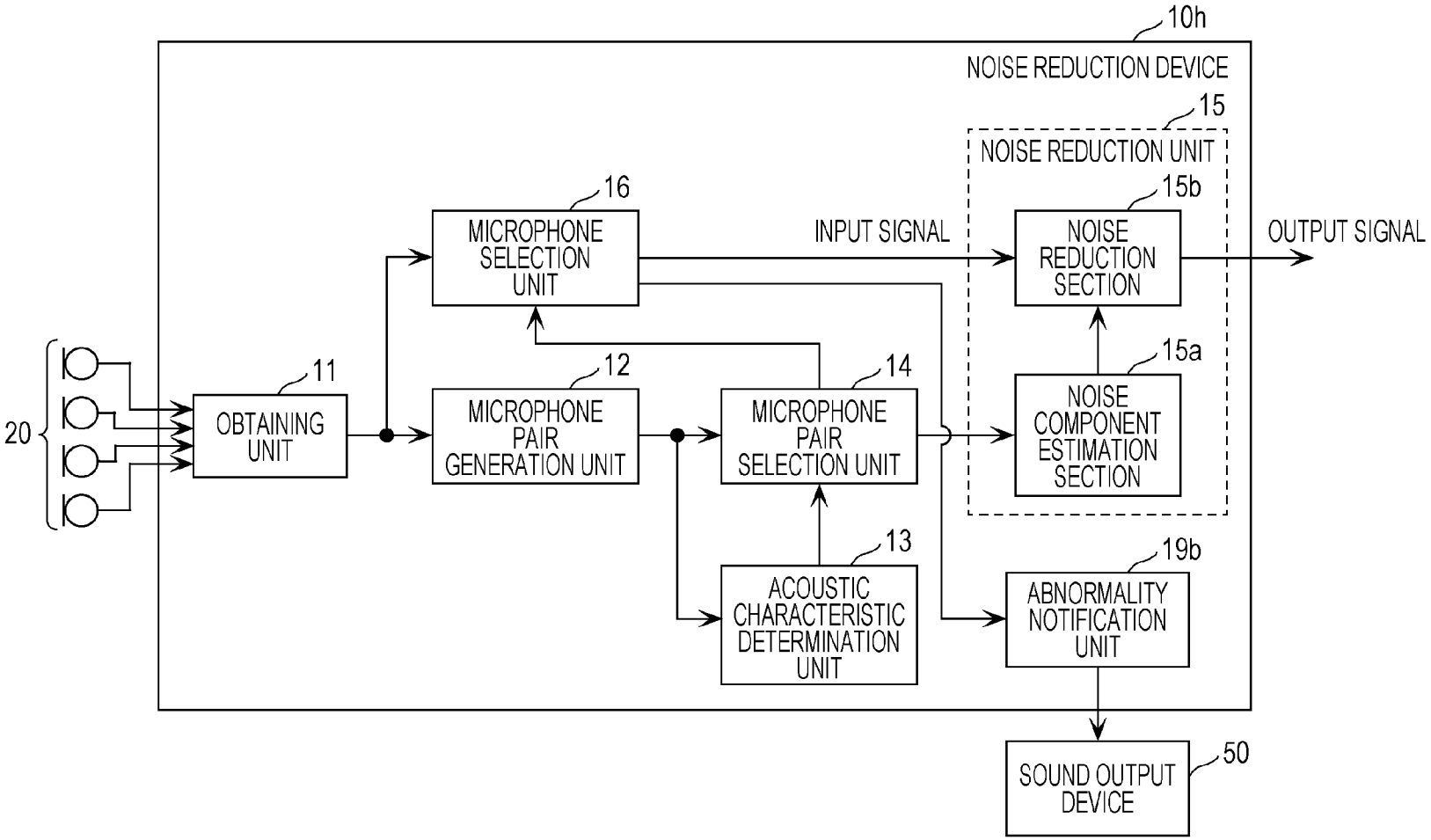
FIG. 17 is a block diagram illustrating the functional configuration of a noise reduction device according to a first modification of the fourth embodiment.

Among the above-described noise reduction devices, ones including the microphone selection unit 16, such as the noise reduction device 10*a*, may include an abnormality notification unit 19*b* that notifies the user of an abnormality. FIG. 17 is a block diagram illustrating the functional configuration of a noise reduction device 10*h* according to a first modification of the fourth embodiment.

The noise reduction device 10*h* illustrated in FIG. 17 is obtained by adding the abnormality notification unit 19*b* to the noise reduction device 10*a*. Alternatively, the abnormality notification unit 19*b* may be added to the noise reduction device 10*b* or the like.

The abnormality notification unit 19*b* notifies the user of an abnormality on the basis of a result of selection performed by the microphone selection unit 16. If there is a microphone 20 excluded by the microphone selection unit 16, for example, the abnormality notification unit 19*a* outputs a control signal to the sound output device 50 to cause the sound output device 50 to output a message for notifying the user of an abnormality. When abnormality notification unit 19*b* is used for an apparatus including a display unit, the abnormality notification unit 19*b* may output a control signal to the display unit to display an image for notifying the user of an abnormality.

With the abnormality notification unit 19*b*, the noise reduction device 10*h* can notify the user of an abnormality.

Second Modification of Fourth Embodiment

Figure 18:
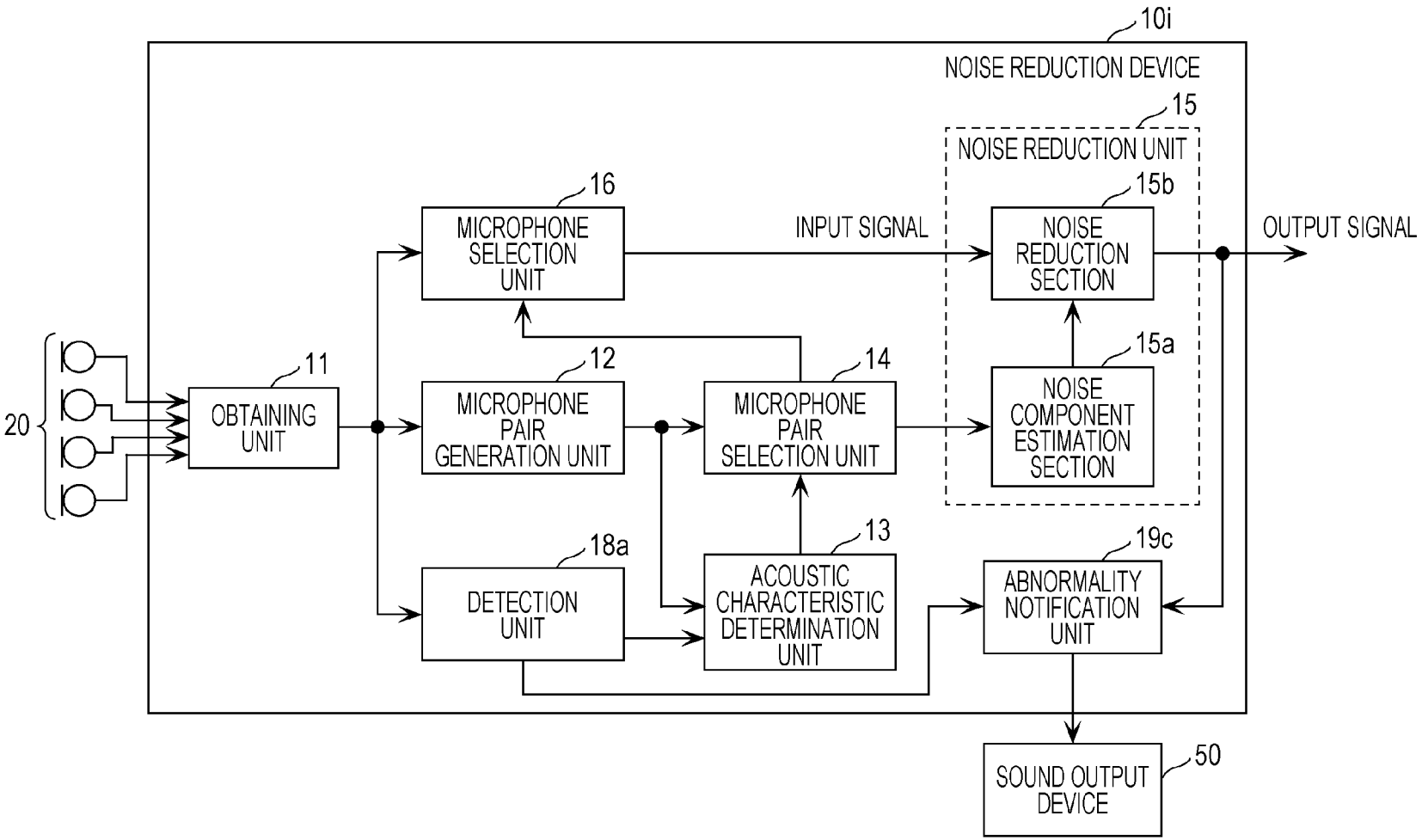
FIG. 18 is a block diagram illustrating the functional configuration of a noise reduction device according to a second modification of the fourth embodiment.

The noise reduction device 10 may include an abnormality notification unit 19*c* that notifies the user of an abnormality on the basis of a signal level of an output signal. FIG. 18 is a block diagram illustrating the functional configuration of a noise reduction device 10*i* according to a second modification of the fourth embodiment.

The noise reduction device 10*i* illustrated in FIG. 18 is obtained by adding the abnormality notification unit 19*c* to the noise reduction device 10*c*. Alternatively, the abnormality notification unit 19*c* may be added to the noise reduction device 10 or the like.

The abnormality notification unit 19*c* notifies the user of an abnormality on the basis of a signal level of an output signal. As described above, an output signal is a signal input after the noise reduction unit 15 reduces noise.

During a target period detected by the detection unit 18*a*, a speech sound having a certain level of volume is input to the plurality of microphones 20. If there is no abnormality, that is, if there is no obstacle around the plurality of microphones 20, therefore, an output signal, as with an input signal, has a certain signal level. If there is an obstacle around the plurality of microphones 20, on the other hand, the user's speech sound is regarded as a noise estimation signal, and a level of an output signal decreases.

The abnormality notification unit 19*c*, therefore, detects a signal level of an output signal during a target period and, if the detected signal level is lower than a threshold, for example, outputs a control signal to the sound output device 50 to cause the sound output device 50 to output a message for notifying the user of an abnormality. When the abnormality notification unit 19*c* is used for an apparatus including a display unit, the abnormality notification unit 19*c* may output a control signal to the display unit to display an image for notifying the user of an abnormality.

With the abnormality notification unit 19*c*, the noise reduction device 10*i* can notify the user of an abnormality.

Other Embodiments

Although some embodiments have been described above, the present disclosure is not limited to these embodiments.

Although it is determined in the first embodiment whether acoustic characteristics of a microphone pair including two microphones satisfy a certain requirement, it may be determined whether acoustic characteristics of a microphone set including three or more microphones satisfy a certain requirement, instead. That is, the present disclosure includes, in addition to the above embodiments, an embodiment in which it is determined whether acoustic characteristics of a microphone set including three or more microphones satisfy a certain requirement. In the above embodiments, the term "microphone pair" may be replaced by "microphone set" as necessary.

In addition, the configurations of the noise reduction devices according to the above embodiments are examples. A noise reduction device may include a component such as a digital-to-analog (D/A) converter, a low-pass filter (LPF), a high-pass filter (HPF), a power amplifier, or an analog-to-digital (A/D) converter. In addition, signal processing performed by a noise reduction device is digital signal processing, for example, but part of signal processing performed by a noise reduction device may be analog signal processing.

In addition, in the above embodiments, the components of the noise reduction devices may be configured by dedicated hardware or may be achieved by executing a software program corresponding to the components. The components of the noise reduction devices may be achieved by reading and executing a software program stored in a recording medium, such as a hard disk or a semiconductor memory, using a program execution unit, such as a central processing unit (CPU) or a processor, instead.

Alternatively, the components of the noise reduction devices may be circuits. These circuits may together form a single circuit, or may be separate circuits. In addition, these circuits may be general-purpose circuits or dedicated circuits.

The noise reduction devices according to the above embodiments may be used for apparatuses other than automatic translation apparatuses. The noise reduction devices may be used, for example, for apparatuses having a speech recognition function, such as smartphones, tablet terminals, and automotive navigation apparatuses. The noise reduction devices may also be used for digital recorders and the like.

The present disclosure also includes modes obtained by modifying the above embodiments in various ways conceivable by those skilled in the art and modes achieved by arbitrarily combining components and functions described in the above embodiments with each other, insofar as the scope of the present disclosure is not deviated from.

A noise reduction device in the present disclosure is effective as a noise reduction device used for automatic translation apparatuses and the like.

What is claimed is:

1. A noise reduction device, comprising:

a plurality of microphones;

a processor; and a memory storing a computer program, which, when executed by the processor, causes the processor to perform operations including obtaining a microphone set signal from each of a plurality of microphone sets, each of the plurality of microphone sets including an arbitrary combination of two or more of the plurality of microphones, determining, using the microphone set signal, whether an acoustic characteristic of each of the plurality of microphone sets satisfies a predetermined requirement, selecting, from among the plurality of microphone sets, a target microphone set, whose acoustic characteristic has been determined to satisfy the predetermined requirement, and reducing, using the microphone set signal obtained from the target microphone set, noise included in an input signal obtained from at least one of microphone signals output from the plurality of microphones, wherein the reducing includes filtering the microphone set signal, obtained from the target microphone set, to obtain a noise estimation signal and reducing the noise estimation signal from the input signal.

2. The noise reduction device according to claim 1, wherein the obtaining of a microphone set signal includes obtaining a first microphone signal from a first microphone, which is included in one of the plurality of microphone sets, obtaining a second microphone signal from a second microphone, which is included in the one of the plurality of microphone sets, delaying the first microphone signal by a first angular difference between a reference direction and a first speech direction, the first speech direction being a direction of the first microphone from an utterer, delaying the second microphone signal by a second angular difference between the reference direction and a second speech direction, the second speech direction being a direction of the second microphone from the utterer, and subtracting the delayed second microphone signal from the delayed first microphone signal to generate a microphone set signal, and wherein, in the determining, when a value of the microphone set signal is smaller than a predetermined value, it is determined that the microphone set signal satisfies the predetermined requirement.

3. The noise reduction device according to claim 1, wherein the operations further include selecting, from among the plurality of microphones, a target microphone included in the target microphone set, wherein the reducing reduces the noise included in the input signal, which is a microphone signal obtained from the target microphone.

4. The noise reduction device according to any one of claims 1 to 3, wherein the operations further include detecting a target period for which sound levels of the microphone signals output from the plurality of microphones are higher than a predetermined level, and wherein the determining is performed using microphone set signals obtained from the plurality of microphone sets in the target period.

5. The noise reduction device according to any one of claims 1 to 3, wherein the operations further include detecting, as an utterance start timing, a timing of an operation performed by a user before the user utters a speech sound, wherein the determining is performed using microphone set signals obtained from the plurality of microphone sets after the detected utterance start timing.

6. The noise reduction device according to any one of claims 1 to 3, wherein the operations further include detecting a sound output start timing of a sound output device located around the plurality of microphones, and wherein the determining is performed using microphone set signals obtained from the plurality of microphone sets after the detected sound output start timing.

7. The noise reduction device according to claim 1, further comprising:

a recording medium configured to store the microphone signals output from the plurality of microphones, wherein the noise included in the input signal, obtained from at least one of the microphone signals output from the plurality of microphones and stored in the recording medium before the determining, is reduced in the reducing when it is determined in the determining that an acoustic characteristic of at least one of the plurality of microphone sets does not satisfy the predetermined requirement.

8. The noise reduction device according to claim 1, wherein the operations further include notifying a user of an abnormality on the basis of a result of the determining.

9. The noise reduction device according to claim 3, wherein the operations further include notifying a user of an abnormality on the basis of a result of the selecting.

10. The noise reduction device according to claim 4, wherein the operations further include notifying a user of an abnormality on the basis of a signal level of an output signal, which is the input signal whose noise has been reduced in the reducing.

11. The noise reduction device according to claim 1, wherein the microphone set signal includes two or more microphone signals, and wherein the reducing includes multiplying each of the two or more microphone signals by filtering coefficients to obtain the noise estimation signal.

12. A method for reducing noise, the method comprising:

obtaining a microphone set signal from each of a plurality of microphone sets, each of the plurality of microphone sets including an arbitrary combination of two or more of the plurality of microphones;

determining, using the microphone set signal, whether an acoustic characteristic of each of the plurality of microphone sets satisfies a predetermined requirement;

selecting, from among the plurality of microphone sets, a target microphone set, whose acoustic characteristic has been determined to satisfy the predetermined requirement; and reducing, using the microphone set signal obtained from the target microphone set, noise included in an input signal obtained from at least one of microphone signals output from the plurality of microphones, wherein the reducing includes filtering the microphone set signal, obtained from the target microphone set, to obtain noise estimation signal and reducing the noise estimation signal from the input signal.

13. A non-transitory recording medium storing a computer program, which, when executed by a processor, causes the processor to perform the method for reducing noise according to claim 12.

* * * * *